US008390642B2

(12) United States Patent
Frederick et al.

(10) Patent No.: US 8,390,642 B2
(45) **Date of Patent: *Mar. 5, 2013**

(54) SYSTEM AND METHOD FOR COLOR SPACE SETTING ADJUSTMENT

(75) Inventors: John W. Frederick, Houston, TX (US); Robert L. Myers, Ft. Collins, CO (US); David Allen Prouty, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 523 days.

This patent is subject to a terminal disclaimer.

(21) Appl. No.: 12/433,059

(22) Filed: Apr. 30, 2009

(65) Prior Publication Data

US 2010/0277492 A1 Nov. 4, 2010

(51) Int. Cl.
*G09G 5/02* (2006.01)

(52) U.S. Cl. ..... 345/590; 345/102; 345/600; 345/601; 345/602; 345/603; 345/604; 345/644

(58) Field of Classification Search ..... 345/589, 345/590, 102, 600–604, 644
See application file for complete search history.

(56) References Cited

U.S. PATENT DOCUMENTS

| | | | | |
|---|---|---|---|---|
| 6,778,216 | B1 * | 8/2004 | Lin | 348/333.11 |
| 7,068,263 | B2 * | 6/2006 | Evanicky et al. | 345/207 |
| 2005/0083344 | A1 * | 4/2005 | Higgins | 345/600 |
| 2007/0279372 | A1 * | 12/2007 | Brown Elliott et al. | 345/102 |

* cited by examiner

*Primary Examiner* — Ke Xiao
*Assistant Examiner* — Kim-Thanh T Tran

(57) ABSTRACT

Disclosed are various systems and methods of color space setting adjustment. In one embodiment, a system includes an LED RGB backlight as well as a color gamut mapping engine configured to adjust a plurality of input values and output a plurality of adjusted input values to an LCD panel having a native transfer function such that the transformation of the adjusted input values to visible light displayed by the LCD panel complies with user defined color space settings.

17 Claims, 7 Drawing Sheets

SYSTEM AND METHOD FOR COLOR SPACE SETTING ADJUSTMENT

BACKGROUND

Liquid crystal display (LCD) screens are widely used desktop or other computing environments. An LCD module includes a liquid crystal panel, a backlight, and associated drive electronics. An LCD display can include an LCD module and associated front end electronics that may include video inputs, peripheral inputs (e.g. USB), scaler, processor, power supply electronics, etc. Color critical displays are widely used in professional photography, video and/or graphics environments, or other environments in which color critical displays may be desired.

DETAILED DESCRIPTION OF THE DRAWINGS

Figure 1:
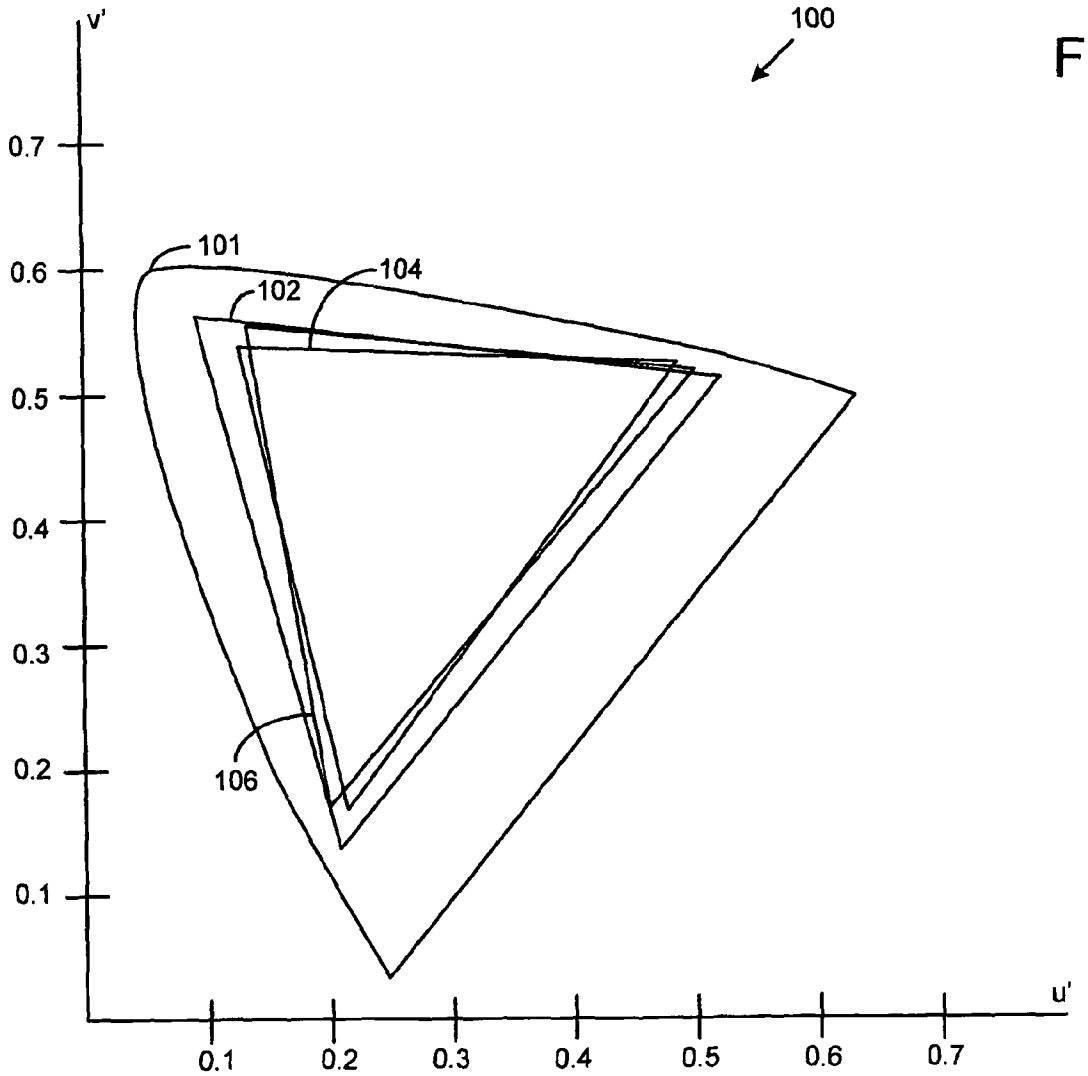
FIG. 1 is a drawing of a chromaticity chart depicting the 1976 CIE u'v' color space and various standard output device specification color gamuts.

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

Reference is now made to FIG. 1, which depicts an exemplary chromaticity chart 100 on which various color gamuts are plotted. As one non-limiting example, the 1976 CIE u'v' color space 101 is depicted by the chromaticity chart 100, which depicts a mapping of human color perception in terms of two CIE parameters u' and v'. Also shown within the chromaticity chart 100 are color gamuts of various color spaces defined by various standard output device specification are depicted within the 1976 CIE u'v' color space.

For example, the Adobe® RGB color space is defined by the first triangle 102. In other words, the first triangle 102 defines the color gamut of a display device conforming to the Adobe® RGB output device specification within the depicted 1976 CIE u'v' color space. The second triangle 104 can define defines a sRGB/Rec. 709 output device specification. The third triangle 106 can define a SM PTE-C output device specification. Other output device specifications can also be plotted without the 1976 CIE u'v' color space depicted in the chomaticity chart 100 as can be appreciated. It should also be appreciated that the depicted color gamuts on the chromaticity chart 100 are not necessarily to scale, and are shown to illustrate that various output device specifications have varying color gamuts within the 1976 u'v' CIE color space 101.

These standard output device specifications represent an expected response by a display that is designed to comply with such a specification. In other words, for a given input value for a particular pixel on such a display, any display conforming to a particular standard output device specification is expected to emit substantially the same perceived colors for a given set of input values as another device conforming to the same standard. Stated another way, any display conforming to the particular standard output device specification is expected to have substantially the same transfer function or gamma response curve. In addition, these specifications also specify other color space settings, including, but not limited to, RGB primaries, white point, and white luminance with which a conforming display must comply. The RGB primaries of a standard output device specification specify the chromaticities of primary colors (e.g., red, green and blue). Likewise, a white point specified by a standard output device specification define tristimulus values and/or chromaticity coordinates that serve to define a target white or reference white of a conforming display.

Figure 2:
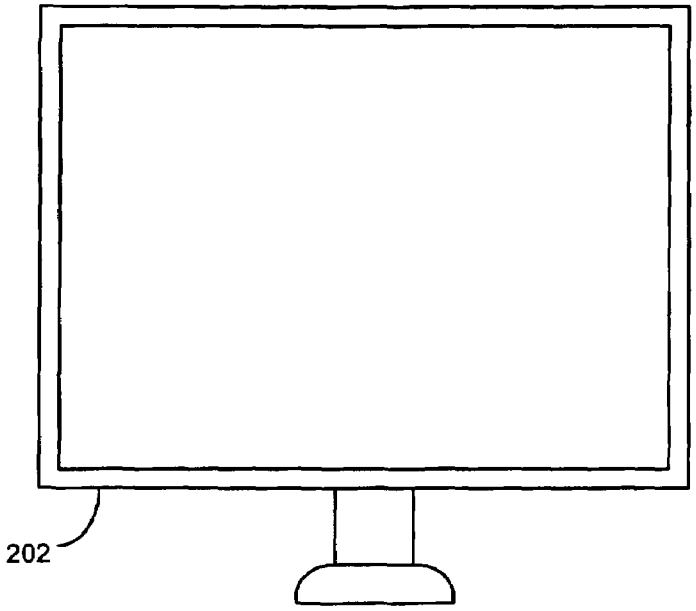
FIG. 2 is a drawing of a LCD display according to an embodiment of the disclosure.

Reference is now made to FIG. 2, which depicts a color critical liquid crystal display 202 (LCD) according to an embodiment of the disclosure. The LCD display 202 is configured with the capability to comply with a variety of standardized output device specifications. In one embodiment, the LCD display 202 is configured with a 10-bit LCD panel and a light emitting diode (LED) backlight incorporating red, green and blue LEDs, and has a native color gamut that is wider or offers a more dynamic range than many standardized output device specifications employed in color critical settings. In one embodiment, the LCD panel includes at least three addressable subpixels corresponding to a pixel of the display, each of which can be assigned a 10-bit value. Each of the subpixels can correspond to an individual red, green, or blue subpixel, respectively. Accordingly, because a 10-bit LCD panel can be employed, each subpixel can produce 210 levels of intensity. Because (in the above non-limiting example) each pixel corresponds to the three red, green, and blue subpixels, $(2^{10})^3$ discrete colors can be reproduced from each pixel on the display. It should be appreciated that embodiments according to the disclosure can employ LCD panels supporting various bit depths, and that the above example is non-limiting.

In addition, an LED backlight is employed, as opposed to a cold cathode fluorescent lamp (CCFL) backlight, which permits white point control of via the backlight without adjusting red, green, and/or blue maximum levels of the subpixels of the panel itself. In other words, because the red, green, and blue channels of the backlight can be independently controlled, a white point can be chosen and/or varied according to various standard output device specifications without compensating the maximum subpixel values assignable for red, green, and blue subpixels, which can often be a compromise employed in a display employing a CCFL backlight.

Figure 3:
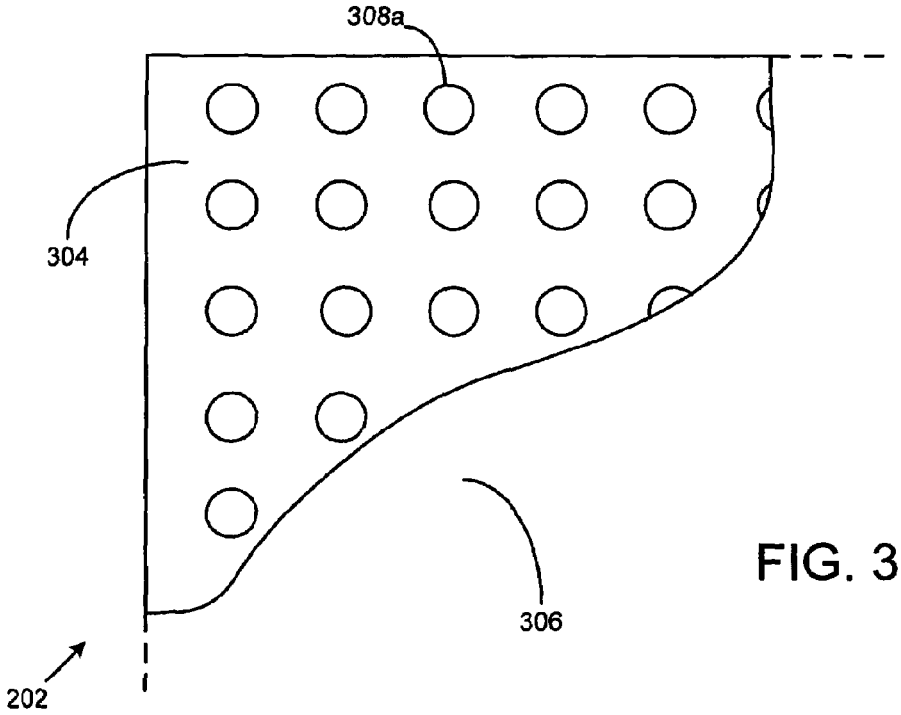
FIG. 3 is a cutaway drawing of an LCD display according to an embodiment of the disclosure.

Reference is now made to FIG. 3, which depicts a cutaway view of the LCD display 202 according to the disclosure. FIG. 3 illustrates an RGB LED backlight 304 employed according to embodiments of the disclosure. In one embodiment, the RGB LED backlight 304 can be configured as an array of LED clusters 308 that can independently emit red, green, and blue light and/or combinations thereof. The LED clusters 308 of the RGB LED backlight 403 can emit light from behind the LCD panel 302, and the backlight employed to improve visibility of pixels in the LCD panel 306, particularly low light conditions. In addition, because the RGB LED backlight 304 includes a plurality of LED clusters 308 having the capability to emit red, green, and blue light, the levels of red, green, and blue light emitted by each of the LED clusters can be varied in order to produce various luminance and/or white point settings according to the desires of a user or to comply with one or more standard output device specifications.

It should be appreciated that various standard output device specifications can define varying color gamuts, each having a varying definition of a white point. Accordingly, as noted above, the RGB LED backlight 304 permits an adjustable white point depending on a standard output device specification chosen, which can be employed without adjusting the maximum subpixel values assignable for red, green, and blue subpixels of the LCD panel 306 in order to compensate for a non-white output of an alternative backlight.

Figure 4:
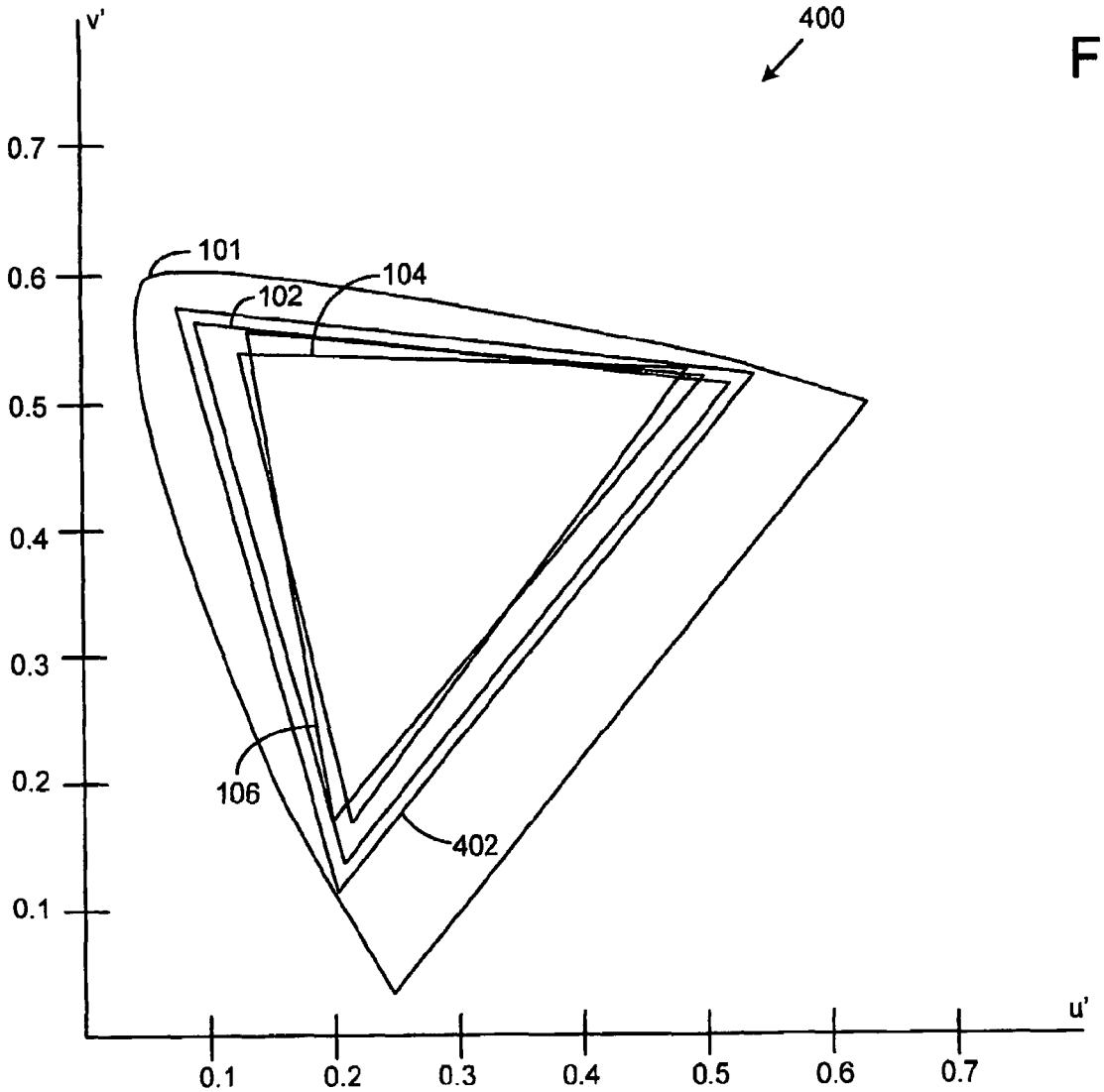
FIG. 4 is a drawing of a chromaticity chart depicting the 1976 CIE u'v' color space, various standard output device specification color gamuts, and a color gamut of the LCD panel of the LCD display according to an embodiment of the disclosure.

Reference is now made to FIG. 4, which depicts the exemplary chromaticity chart 100 of FIG. 1 on which various color gamuts are plotted. As noted above, the 1976 CIE u'v' color space 101 is depicted by the chromaticity chart 100, which depicts a mapping of human color perception in terms of two CIE color coordinates u' and v'. Also shown within the chromaticity chart 100 are color gamuts of various color spaces defined by various standard output device specification are depicted within the 1976 CIE u'v' color space 101. Accordingly, FIG. 4 depicts a triangle 402 corresponding to a color gamut of an LCD panel 306 employed in an embodiment of the disclosure. The color gamut represented by the triangle 402 "encloses" the color gamuts represented by the various exemplary standard output device specifications 102, 104, 106. In other words, the LCD panel 306 displays a more dynamic range of colors than the colors specified by various standard output device specifications. Therefore, input values provided to an LCD display according to an embodiment of the disclosure can be adjusted in order to facilitate compliance with standard output device specifications, as is discussed hereinbelow.

Figure 5:
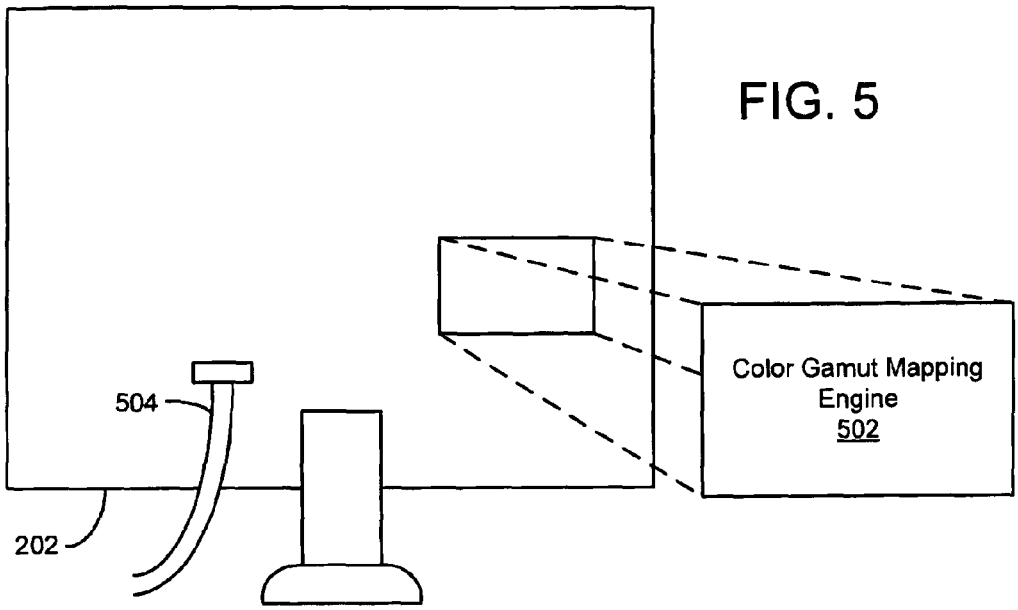
FIG. 5 is a drawing of an LCD display and color gamut mapping engine according to an embodiment of the disclosure.

Reference is now made to FIG. 5, which illustrates an alternative depiction of the LCD display 202 according to an embodiment of the disclosure. The LCD display 202 includes a color gamut mapping engine 502 that permits the LCD display 202 to comply with a variety of standard output device specifications. The color gamut mapping engine 502 can be included in associated front end electronics of an LCD display. The color gamut mapping engine 502 permits the above flexibility by adapting input values from a computer graphics system to adapt to a standard output device specification. In addition, the light emanated by the RGB LED backlight can also be adjusted to vary properties such as white point and luminance. To implement the above mentioned functionality, the color gamut mapping engine 502 adjusts input values received by the monitor based upon the native color gamut of the LCD display 202, which can be determined upon the manufacture of the LCD display 202 taking into account the response characteristics of the LCD panel and the RGB LED backlight in response to various inputs.

Because the native color gamut of the LCD panel "encloses" various gamuts corresponding to standard output device specifications used in the art, the adjusted input values can be generated by the color gamut mapping engine 502 cause the LCD display 202 to emulate a standard output device specification. In other words, as noted with respect to the discussion regarding FIG. 1, because the LCD panel can display a broader range of colors relative to the color gamut of various standard output device specifications, the input values can be adjusted by the color gamut mapping engine 502 to emulate the gamma response curve and other properties (e.g., RGB primaries, white point, luminance) that are associated with a particular standard output device specification. Additionally, in some embodiments, the light emanated by the RGB LED backlight can be varied in order to modify the white point and/or luminance of the LCD display to comply with a particular standard output device specification.

The color gamut mapping engine 502 can also allow a user to select from among various standard output device specifications that can be preprogrammed in the color gamut mapping engine 502. In one embodiment, the color gamut mapping engine 502 or other memory accessible to the LCD display 201 can be configured to store the various color space settings of various standard output device specifications, including, but not limited to, sRGB, SMPTE-C, Adobe® RGB, and SMPTE-431-2. In another embodiment, the color gamut mapping engine 502 or other memory can be configured to store settings that direct how input values and/or the RGB LED backlight should be adjusted in order to compensate for the native properties of the LCD panel such that the LCD display 202 complies with various standard output device specifications.

Accordingly, a user may select a standard output device specification that the user wishes the LCD display 202 to emulate. Additionally, the user may switch between various specifications that the LCD display 202 can emulate, which provides the ability for a user to view content in various output device specifications on a single LCD display 202 without having to recalibrate the monitor for each specification. The color gamut mapping engine 502 can be configurable in this way by commands sent via an input/output interface 504 to the LCD display 202. An input/output interface can include, but is not limited to, a Universal Serial Bus (USB) interface, Ethernet interface, a Data Display Channel/Command Interface (DDC/CI), and other input/output interfaces as can be appreciated.

Additionally, a user may also specify various color space settings that can include, but are not limited to: RGB primary chromaticities, display white point, gamma or transfer function, luminance, or other display properties or color space settings that may vary from those specified by a standard device output specification. Accordingly, a user interface to facilitate such functionality can be provided on a personal computer via color calibration software or within the LCD display 201 itself via an on screen display (OSD) that can be overlaid onto the input video signals processed by the LCD display 201 and/or one or more input devices (e.g. buttons, touch screen) on the LCD display 201. These user defined settings can be stored within the color gamut mapping engine 502 or other memory accessible to the LCD display 2021. In this way, a user to create, calibrate, and store these various monitor settings and switch between user defined settings and/or standard output device specifications without a complete recalibration of the monitor.

Figure 6:
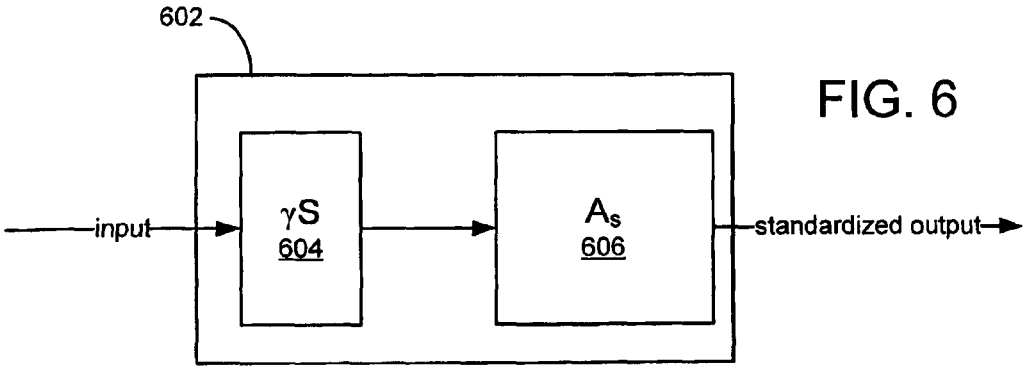
FIG. 6 is a drawing of a transformation of input values to standardized output.

Reference is now made to FIG. 6, which depicts a transformation of input values from a graphics card, graphics engine of a computer system or other video signal into a standardized output or user defined color space settings that correspond to the chromaticities for each pixel of a display device 602. In other words, the standardized output or user defined color space settings can correspond to a hue, intensity, and saturation of pixels of a display device 602. As a non-limiting example, in one embodiment, the input values received by the display device 602 can correspond to RGB color codes for each pixel of the display device 602. The RGB color codes can represent the relative values of red, green and blue levels for each pixel of the display device 602. Accordingly, the standardized output can be transmitted to an LCD panel and cause the LCD panel to display corresponding intensity, hue, and saturation for each of the pixels of the LCD display based upon these RGB color codes.

As noted above, input values can be received in terms of RGB codes, or other values generated by a graphics subsystem of a computer system or the like. These input values can be gamma corrected or mapped to an intensity of light output by the device for each primary color, or light output levels, which may also be referred to herein as a transfer function or gamma curve of a display. The gamma corrected input values are then output to a display, which causes pixels and/or subpixels of a display panel, cathode ray tube (CRT) or the like to display an image. Because a specific display panel may possess its own native light output function, the output values in terms of light output, or in terms of the specific primary colors and their intensities, depend on such a native light output function, as can be appreciated.

With specific reference to the drawing of FIG. 6, shown is one non-limiting illustration of a transformation of input values from a graphics card, graphics engine, or other video signal and light output by a standardized display. The depicted standardized display is a display device 602 that conforms to a standard output device specification as noted above. Accordingly, the input values (e.g., RGB codes, etc.) are gamma corrected or transformed by a native transfer function block 604. The native transfer function block 604 gamma corrects input values, whether they may include RGB codes or other values from a graphics system or subsystem, according to a standardized gamma curve ($\gamma S$) or transfer function specifically defined by the standard output device specification. In the case of input values that are in the form of RGB codes, the gamma correction or a transfer function can be implemented as at least one lookup table that translates an RGB code and/or its components (e.g. values corresponding to red, green, and blue) into corresponding a corresponding gamma adjusted RGB code and/or components (e.g., a gamma adjusted red, green, and blue).

As a non-limiting example, if the display device 602 conforms to the sRGB specification, it should be appreciated that the gamma of the sRGB specification is approximately 2.2. Accordingly, the native transfer function block 604 applies such a transfer function to the input values to the display device 602. These gamma corrected input values produced by the native transfer function block 604 are accordingly interpreted by the standardized display panel or other display component, which map the gamma corrected input values to resulting output levels of the correct intensity and color in the form of a standardized output. The standardized output represents the light output by a standardized display having a standardized display panel with a standardized light output function 606 ($A_s$) and implementing a standardized transfer function or gamma curve ($\gamma S$) as defined by a standardized output device specification. In one embodiment, the standardized light output function 606 ($A_s$) can be implemented as a matrix multiplication operation of the gamma corrected input values and appropriate tristimulus values for the primaries, white point, luminance of a display.

Figure 7:
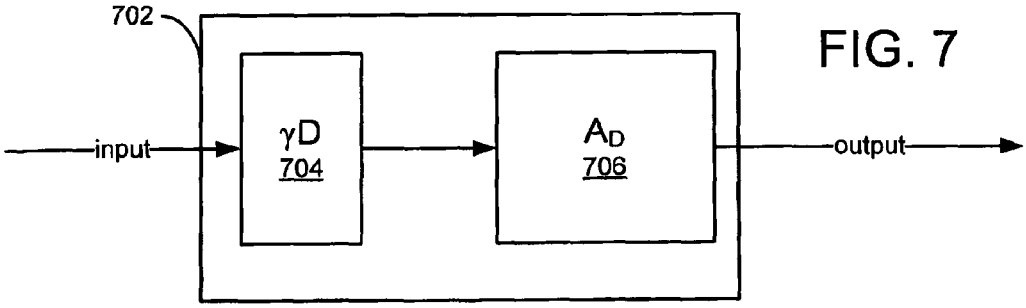
FIG. 7 is a drawing of a transformation of input values to output.

Reference is now made to FIG. 7, which depicts one non-limiting illustration of a transformation of input values from a graphics card, graphics engine, or other video signal to light output by a non-standard display 702. The display 702 represented by FIG. 7 has a native transfer function or gamma curve as well as a native light output function that may vary from a standard output device specification. In the case of a display having a native transfer function and/or native light output function that varies from a standard output device specification, the depicted non-standard display 702 is a display that does not conform to a standard output device specification as described above. Accordingly, the input values (e.g., RGB codes, etc.) are gamma corrected or transformed by a non-standard native transfer function block 704. However, the non-standard native transfer function block 704 gamma corrects input values, whether they may include RGB codes or other values from a graphics system or subsystem, according to a native gamma curve ($\gamma D$) or transfer function that varies from one specifically defined by various standard output device specifications.

In other words, the non-standard native transfer function block 704 applies such a transfer function to the input values to the non-standard display 702. These gamma corrected input values produced by the non-standard native transfer function block 704 are accordingly interpreted by a display panel of the non-standard display 702, which maps the gamma corrected input values to resulting output levels of an intensity and color in the form of a non-standard output. The non-standard output represents the light output by the non-standard display 702 having a non-standard display panel with a native light output function ($A_D$) and implementing a non-standard transfer function or gamma curve ($\gamma D$) that varies from those specifically defined standard output device specifications. It should be appreciated that in the context of this disclosure, a non-standard display 702 can also refer to a display that conforms to a first standard output device specification where as user may desire a second output device specification.

Figure 8:
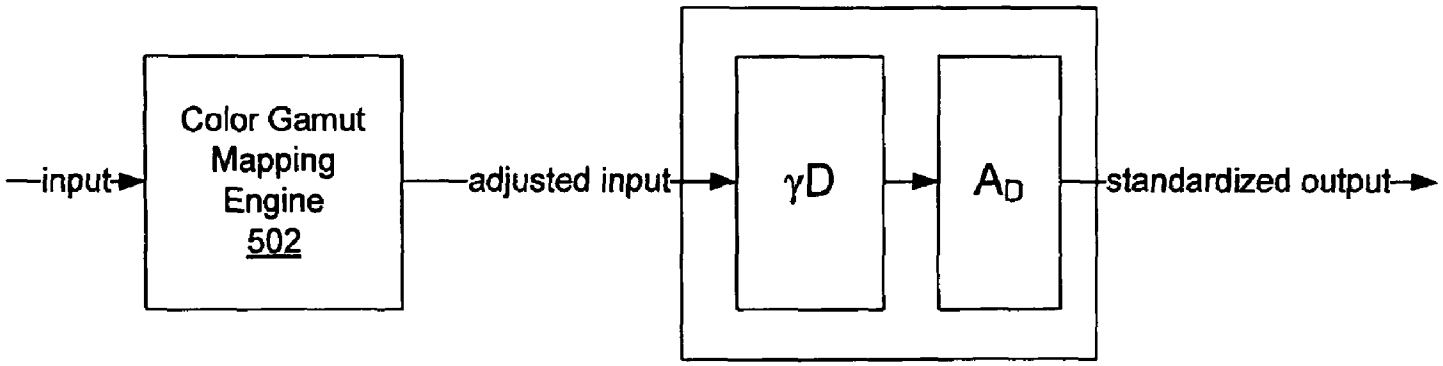
FIG. 8 is a drawing of a transformation of input values to standardized output according to an embodiment of the disclosure.

Accordingly, FIG. 8 depicts one embodiment of the disclosure in which the color gamut mapping engine 502 can be employed in an LCD display 202 to compensate input values from a graphics card, graphics engine, or other video signal such that output values in the form of a light output by the LCD panel 302 conform to a standard output device specification. In other words, an LCD display 202 employing the color gamut mapping engine 502 adjusts input values (e.g., RGB codes) so that the native gamma curve or transfer function and light output function of the LCD display 202 result in standardized output values (in terms of light output by the display) according to a standard output device specification.

Accordingly, an LCD display 202 according to an embodiment of the disclosure includes an LCD panel 302 and RGB LED backlight 304 as discussed hereinabove. In addition, the LCD display 202 is configured with a color gamut mapping engine 502. In one embodiment, the LCD display 202 and/or LCD panel 302 possesses native characteristics (e.g., $\gamma_D$ and $A_D$) that can be known or ascertained by determining the response characteristics of the LCD panel to various inputs. As can be appreciated, even LCD panels 302 of the same manufacture can have slight variations in response characteristics. Accordingly, the color gamut mapping engine 502 can be configured based upon the response characteristics of the LCD panel 302 so that input values can be adjusted to allow the LCD display 202 to conform to a variety of standard output device specifications. Because the native response characteristics of the LCD display 202 are known or can be ascertained, the color gamut mapping engine 502 can adjust input values to compensate for the native characteristics so that, for example, the native gamma curve and light output function cause the output from the LCD display 202 to conform to a standardized output.

Figure 9:
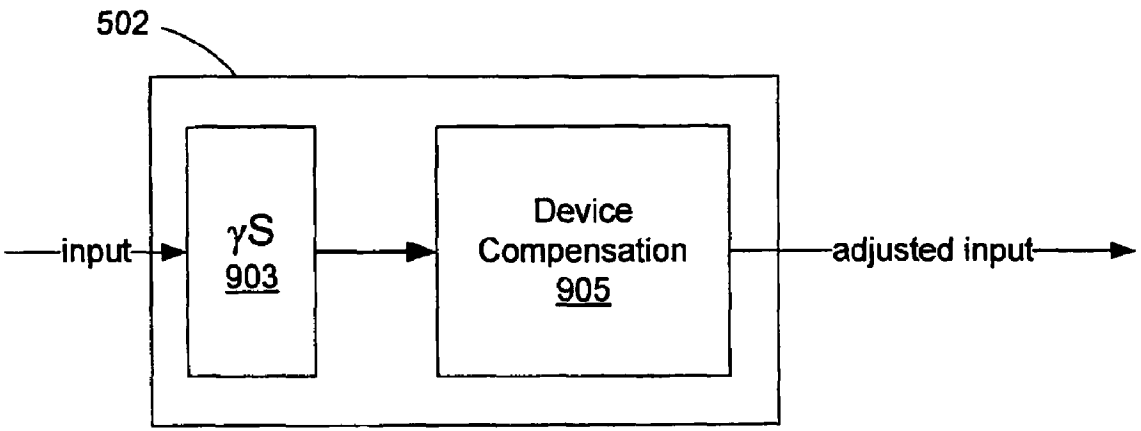
FIG. 9 is a drawing of a color gamut mapping engine according to an embodiment of the disclosure.

Reference is now made to FIG. 9, which depicts one non-limiting embodiment of a color gamut mapping engine according to the disclosure. In the depicted example, the color gamut mapping engine 502 is configured to adjust input values received from a graphics card, graphics engine, or other video signal (e.g., RGB codes) to allow an LCD display 202 to comply with various standard output device specifications. Accordingly, the color gamut mapping engine 502 applies a gamma curve or transfer function defined by a particular standard output device specification. In other words, the color gamut mapping engine 502 applies a target transfer function defined by the specification because devices complying with the specification are expected to perform gamma correction in accordance with a specified gamma curve.

Accordingly, the color specification transform block 903 applies a target transfer function defined by a standard output device specification to the input values and outputs a standardized gamma corrected input value associated with each of the input values. As noted above, in the case of input values that are in the form of RGB codes, the color specification transform block 903 can be implemented as at least one lookup table that translates an RGB code and/or its components (e.g. values corresponding to red, green, and blue) into corresponding a corresponding gamma adjusted RGB code and/or components (e.g., a gamma adjusted red, green, and blue). Accordingly, such a lookup table can facilitate translation of the input values to standardized gamma corrected input values.

The color gamut mapping engine 502 further includes a device compensation block 905 that adjusts the standardized gamma corrected input values to compensate for the native characteristics of the LCD display and/or LCD panel employed. As noted above, the native gamma curve or transfer function and native light output function, or the LCD display characteristics, can be known or ascertained. Accordingly, the device compensation block 905 adjusts the standardized gamma corrected input values so that the native gamma curve and native light output function result in standardized output by the LCD display 202 according to a standard output device specification. Therefore, the device compensation block 905 receives the standardized gamma corrected input values and outputs adjusted input values that can be interpreted by the LCD display 202 and/or LCD panel 302 (according to the native characteristics of the LCD display and/or LCD panel) to produce standardized light output from the LCD display.

Figure 10:
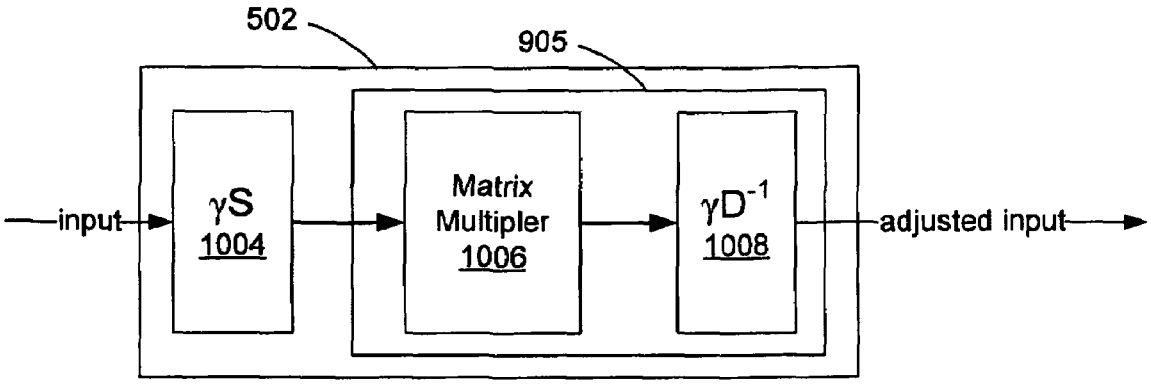
FIG. 10 is a alternative depiction of a color gamut mapping engine according to an embodiment of the disclosure.

Reference is now made to FIG. 10, which depicts one implementation of a color gamut mapping engine 502 according to the disclosure. The depicted color gamut mapping engine 502 adjusts input values received from a graphics card, graphics engine, or other video signal (e.g., RGB codes) to allow an LCD display 202 according to an embodiment of the disclosure to comply with various standard output device specifications by compensating for the native characteristics of an LCD display 202 that may vary from a standard output device specification. In the depicted embodiment, the color gamut mapping engine 502 includes a target transfer function lookup table 1004, which facilitates gamma correction of the input values according to a standardized gamma curve. In other words, a target transfer function is applied to the input values.

As described above, in the case of input values that are in the form of RGB codes, a gamma curve or a transfer function can be implemented as at least one lookup table that translates an RGB code and/or its components (e.g. values corresponding to red, green, and blue) into corresponding a corresponding gamma adjusted RGB code and/or components (e.g., a gamma adjusted red, green, and blue). In other words, such a lookup table can include a plurality of possible standardized gamma corrected input values associated with a plurality of possible input values. Accordingly, such a lookup table can be configured to implement a standardized gamma curve defined by a standard output device specification.

In the depicted embodiment, the device compensation block 905 includes a matrix multiplier 1006 configured to multiply the standardized gamma corrected input values by a transformation matrix and produce a plurality of multiplied input values corresponding to each of the standardized gamma corrected input values. In the case of input values that correspond to RGB codes, the matrix multiplier 1006 outputs a plurality of multiplied input values corresponding to each component of an RGB code (e.g., red, green, and blue). In one embodiment, the transformation matrix employed by the matrix multiplier 1006 is an inverse of the native light output function of the LCD display multiplied by a standardized light output function corresponding to a standard output device specification. As referenced above, a light output function corresponding to an LCD display and/or LCD panel can be implemented as a matrix multiplication operation gamma corrected input values and appropriate tristimulus values for the primaries, white point, luminance of a display. In the depicted example, the inverse of the native light output function of the LCD display and a standardized light output function can be represented by respective matrices that are combined to form the transformation matrix.

The values output by the matrix multiplier 1006, or multiplied input values, are then inverse gamma corrected using an inverse of the native gamma curve or transfer function ($\gamma D^{-1}$) of the LCD display. Accordingly, the native inverse transfer function block 1008 can apply the native inverse transfer function and generate adjusted input values that the LCD display and/or LCD panel can interpret and cause light to be output by the various pixels and/or subpixels therein. The resulting output from the LCD display can be a standardized output according to a standard output device specification.

In other words, because the properties of a standard output device specification (e.g., transfer function and light output function) can be known or ascertained, the color gamut mapping engine 502 can be configured to allow an LCD display 202 having native properties that vary from a specification to respond to input values as a display conforming to a standard output device specification would respond. In addition, because the LCD panel 306 and RGB LED backlight 304 allow the display to possess a native color gamut that is broader than various standard output device specifications, an LCD display 202 according to an embodiment of the disclosure can comply with a wide range of standard output device specifications employed in the art.

Figure 11:
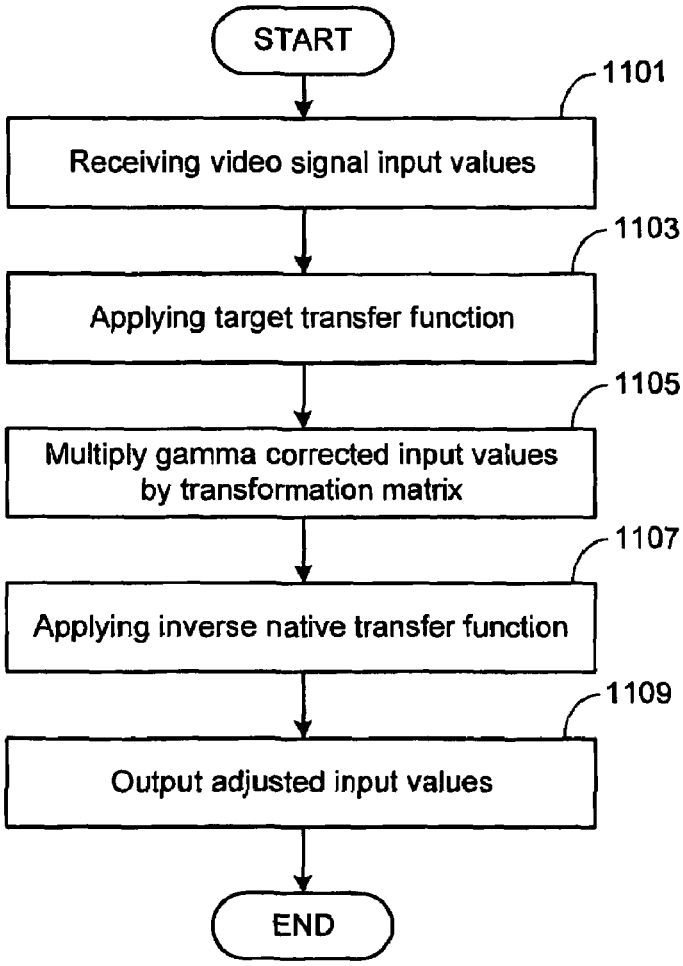
FIG. 11 is a drawing of a process according to an embodiment of the disclosure.

Reference is now made to FIG. 11, which depicts one example of the execution of the color gamut mapping engine 502. The flowchart of FIG. 11 may also be viewed as depicting steps of a method implemented in accordance with various embodiments of the disclosure. It is understood that the flowchart of FIG. 11 is merely an example of functionality in the color gamut mapping engine 502, and that other functions may be implemented in the color gamut mapping engine 502 as described herein.

In this respect, in step 1101, the color gamut mapping engine 502 receives input values input values received from a graphics card, graphics engine, or other video signal (e.g., RGB codes) destined for interpreting and display by an LCD display 202 according to an embodiment of the disclosure. In step 1103, the color gamut mapping engine 502 applies a target transfer function, or a transfer function specified by a standard output device specification that a user wishes the LCD display 202 to emulate. In step 1105, the standardized gamma corrected input values are multiplied by a transformation matrix. In one embodiment, as noted above, the transformation matrix is an inverse of the native light output function of the LCD display multiplied by a standardized light output function corresponding to a standard output device specification. In step 1107, the inverse of the native transfer function of the LCD display 202 is applied to the matrix multiplied input values. In step 1109, adjusted input values are output the LCD display 202 and/or LCD panel 306. Accordingly, the light output by the LCD display 202 will conform to a standard output device specification whose properties are employed by the color gamut mapping engine 502 in order to produce adjusted input values.

Figure 12:
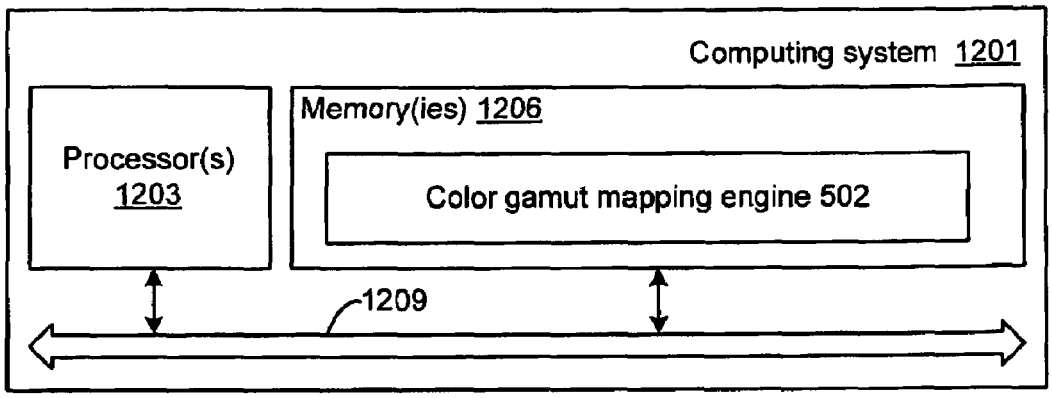
FIG. 12 is a drawing of a computing system implementing a color gamut mapping engine according to an embodiment of the disclosure.

Referring next to FIG. 12, shown is a schematic block diagram of one example of a computing system 1201 in which a color gamut mapping engine 502 can be implemented according to an embodiment of the present disclosure. The color gamut mapping engine 502 can also be implemented within a computing system in an LCD display 202 according to an embodiment of the disclosure. The computing system includes a processor circuit, for example, having a processor 1203 and a memory 1206, both of which are coupled to a local interface 1209. The local interface 1209 may comprise, for example, a data bus with an accompanying address/control bus or other bus structure as can be appreciated.

Stored in the memory 1206 are both executable components and data. In particular, stored in the memory 1206 and executable by the processor 1203 is the color gamut mapping engine 502. It is understood that there may be other applications stored in the memory 1206 and executable by the processor 1203 as can be appreciated. Also, other data may be stored in the memory 1206 and accessed by the processor 1203 associated with the operation of the color gamut mapping engine 502. The color gamut mapping engine 502 may be implemented using any one of, or a combination of, a number of programming languages such as, for example, various processor specific assembler languages, C, C++, C#, Visual Basic, VBScript, Java, JavaScript, Perl, Ruby, Python, Flash, or other programming languages.

A number of software components are stored in the memory 1206 and are executable by the processor 1203. In this respect, the term "executable" means a program file that is in a form that can ultimately be run by the processor 1203. Examples of executable programs may be, for example, a compiled program that can be translated into machine code in a format that can be loaded into a random access portion of the memory 1206 and run by the processor 1203, source code that may be expressed in proper format such as object code that is capable of being loaded into a random access portion of the memory 1206 and executed by the processor 1203, or source code that may be interpreted by another executable program to generate instructions in a random access portion of the memory 1206 to be executed by the processor 1203, etc. An executable program may be stored in any portion or component of the memory 1206 including, for example, random access memory (RAM), read-only memory (ROM), hard drive, solid-state drive, or other memory components.

The memory 1206 is defined herein as both volatile and nonvolatile memory and data storage components. Volatile components are those that do not retain data values upon loss of power. Nonvolatile components are those that retain data upon a loss of power. Thus, the memory 1206 may comprise, for example, random access memory (RAM), read-only memory (ROM), solid-state drives, flash drives, memory cards accessed via a memory card reader, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Although the various components executed on computing system 1201 as described above may be embodied in software or code executed by general purpose hardware as discussed above, as an alternative, the same may also be embodied in dedicated hardware or a combination of software/general purpose hardware and dedicated hardware within an LCD display 202. As one example of dedicated hardware, the same can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowchart of FIG. 11 shows one example of the architecture, functionality, and operation of an implementation of portions of the color gamut mapping engine 502. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor in a computer system or other system. The machine code may be converted from the source code, etc. If embodied in hardware, each block may represent a circuit or a number of interconnected circuits to implement the specified logical function(s).

Although the flowchart of FIG. 11 shows a specific order of execution, it is understood that the order of execution may differ from that which is depicted. For example, the order of execution of two or more blocks may be scrambled relative to the order shown. Also, two or more blocks shown in succession in FIG. 11 may be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present invention.

Also, where the color gamut mapping engine 502 and/or any other component comprises software or code, it can be embodied in any computer-readable medium for use by or in connection with an instruction execution system such as, for example, a processor in a computing system or other system.

In this sense, the color gamut mapping engine 502 and/or any other associated component may comprise, for example, statements including instructions and declarations that can be fetched from the computer-readable medium and executed by the instruction execution system. In the context of the present invention, a "computer-readable medium" can be any medium that can contain, store, or maintain the software or code for use by or in connection with the instruction execution system. The computer readable medium can comprise any one of many physical media such as, for example, electronic, magnetic, optical, electromagnetic, infrared, or semiconductor media. More specific examples of a suitable computer-readable medium include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

a liquid crystal display (LCD) panel having a native transfer function to transform a plurality of adjusted input values and output a plurality of gamma corrected input values and a native light output function to transform the gamma corrected input values into a plurality of light output levels;

an LCD backlight having a plurality of light emitting diode (LED) modules; and a color gamut mapping engine to adjust a plurality of input values corresponding to a video signal and output a plurality of adjusted input values such that the transformation of the adjusted input values to the light output levels complies with at least one color space setting specified by a user; and a color calibration user interface to allow the user to modify the at least one color space setting, in which the color gamut mapping engine further comprises:

a device compensation block comprising:

at least one matrix multiplier to multiply the gamma corrected input value associated with each of the input values by a transformation matrix and output a plurality of multiplied input values; and an inverse native transfer function to apply an inverse of the native transfer function to the multiplied input values and output the adjusted input values;

in which the transformation matrix is a combination of an inverse of the native light output function and a light output function corresponding to the transfer function specified by the at least one color space setting.

2. The system of claim 1, wherein the color calibration user interface is at least one of: an on-screen display menu overlaid on the video signal, and color calibration software executable on a computer system.

3. The system of claim 1, wherein the LED modules are to emit a combination of red light, green light, and blue light.

4. The system of claim 3, wherein the color calibration user interface is further to adjust a white point of the LCD panel by configuring the LCD backlight.

5. The system of claim 4, wherein the white point is adjusted by modifying levels of at least one of: red light, green light, and blue light emitted by the LED modules.

6. The system of claim 1, wherein the at least one color space setting is at least one of: primary color chromaticities, transfer function, white point, and luminance.

7. The system of claim 1, wherein the at least one color space setting is an output device specification with which the transformation of the adjusted input values to the output light levels complies.

8. The system of claim 7, wherein the output device specification is at least one of: sRGB, Adobe RGB, SMPTE-C, and SMPTE-431-2.

9. The system of claim 1, wherein the color gamut mapping engine further comprises:

a color specification transform block to apply a transfer function specified by the at least one color setting to the input values and output a gamma corrected input value associated with each of the input values.

10. The system of claim 9, wherein the color specification transform block further comprises at least one transfer function lookup table, the at least one transfer function lookup table storing a plurality of possible gamma corrected input values associated with a plurality of possible input values.

11. A method, comprising:

receiving at least one color space setting;

receiving a plurality of input values corresponding to a video signal;

applying at least one transfer function to the input values and outputting a plurality of gamma corrected input values; and compensating the gamma corrected input values and outputting a plurality of adjusted input values to a liquid crystal display (LCD) panel having a native transfer function and a native light output function;

in which the adjusted input values result in transformation from the input values to light output by the LCD panel according to the at least one color space setting; and in which compensating the gamma corrected input values further comprises:

performing a matrix multiplication operation of the gamma corrected input values by a transformation matrix and outputting multiplied input values; and applying an inverse of the native transfer function to the multiplied input values and outputting the adjusted input values;

in which the transformation matrix further comprises a combination of an inverse of the native light output function and a light output function corresponding to a specified output device specification.

12. The method of claim 11, further comprising adjusting levels of at least one of red light, green light and blue light emitted by a light emitting diode (LED) backlight coupled to the LCD panel, the adjustment being according to the at least one color space setting.

13. The method of claim 11, wherein the at least one color space setting is at least one of: primary color chromaticities, transfer function, white point, and luminance.

14. The method of claim 11, wherein the at least one color space setting is an output device specification, the output device specification being at least one of: sRGB, Adobe RGB, SMPTE-C, and SMPTE-431-2.

15. A non-transitory computer readable media executable in a computing system, comprising:

logic that receives at least one color space setting;

logic that receives a plurality of input values corresponding to a video signal;

logic that applies at least one transfer function to the input values and outputting a plurality of gamma corrected input values;

logic that compensates the gamma corrected input values and outputting a plurality of adjusted input values to a liquid crystal display (LCD) panel having a native transfer function and a native light output function;

in which the adjusted input values result in transformation from the input values to light output by the LCD panel according to the at least one color space setting; and in which the logic that compensates the gamma corrected input values comprises:

logic that performs a matrix multiplication operation of the gamma corrected input values by a transformation matrix and outputs multiplied input values;

logic that applies an inverse of the native transfer function to the multiplied input values and outputs the adjusted input values in which the transformation matrix further comprises a combination of an inverse of the native light output function and a light output function corresponding to a specified output device specification;

in which the transformation matrix further comprises a combination of an inverse of the native light output function and a light output function corresponding to a specified output device specification;

in which the transformation matrix is a combination of an inverse of the native light output function and a light output function corresponding to the transfer function specified by the at least one color space setting.

16. The computer readable media of claim 15, wherein the at least one color space setting is at least one of: primary color chromaticities, transfer function, white point, and luminance.

17. The computer readable media of claim 15, wherein the at least one color space setting is an output device specification, the output device specification being at least one of: sRGB, Adobe RGB, SMPTE-C, and SMPTE-431-2.

* * * * *